US005475405A

United States Patent [19]

Widder et al.

[11] Patent Number: 5,475,405

[45] Date of Patent: Dec. 12, 1995

[54] CONTROL CIRCUIT FOR REGULATING TEMPERATURE IN AN INK-JET PRINT HEAD

[75] Inventors: John A. Widder, Portland, Oreg.; Peter C. Nicholson, Vancouver, Wash.

[73] Assignee: Hewlett-Packard Company, Palo Alto, Calif.

[21] Appl. No.: 167,595

[22] Filed: Dec. 14, 1993

[51] Int. Cl.[6] ..... B41J 2/05

[52] U.S. Cl. ..... 347/14; 347/60

[58] Field of Search ..... 347/60, 14, 17, 347/57, 19

[56] References Cited

U.S. PATENT DOCUMENTS

| | | | |
|---|---|---|---|
| 4,492,968 | 1/1985 | Lee et al. | 346/140 |
| 4,791,435 | 12/1988 | Smith et al. | 346/140 |
| 4,847,636 | 7/1989 | Durbeck et al. | 346/140 |
| 4,910,528 | 3/1990 | Firl et al. | 346/1.1 |
| 5,059,989 | 10/1991 | Eldridge et al. | 346/140 |
| 5,107,276 | 4/1992 | Kneezel et al. | 346/1.1 |
| 5,168,284 | 12/1992 | Yeung | 347/14 |

FOREIGN PATENT DOCUMENTS

| | | | |
|---|---|---|---|
| 0390202 | 10/1990 | European Pat. Off. | 347/60 |

OTHER PUBLICATIONS

Franco, Sergio "Design with Operational Amplifiers and Analog Integrated Circuits" McGraw Hill Publishing Co., 1988, pp. 293–4, 317–8.

*Primary Examiner*—Benjamin R. Fuller
*Assistant Examiner*—Craig A. Hallacher

[57] ABSTRACT

A temperature control circuit regulates temperature in an ink-jet print head. The control circuit includes a thermal sensor mounted on the print head to measure its temperature and a temperature level detector to determine whether the measured print head temperature exceeds a threshold temperature. The temperature level detector outputs a first signal when the measured print head temperature exceeds the threshold temperature and a second signal when the measured print head temperature does not exceed the threshold temperature. The control circuit also has first logic circuitry to output warming pulses upon receipt of the second signal. The warming pulses have energy insufficient to deposit an ink drop from the print head. Second logic circuitry is configured to output warming pulses to non-selected nozzles of the print head and firing pulses to selected nozzles. In this manner, the print head is automatically warmed via the warming pulses so long as the print head temperature is below a prescribed level. An ink-jet print head incorporating the control circuit is also disclosed.

15 Claims, 3 Drawing Sheets

CONTROL CIRCUIT FOR REGULATING TEMPERATURE IN AN INK-JET PRINT HEAD

TECHNICAL FIELD

This invention relates to ink-jet print heads, and more particularly, to control circuits for operating ink-jet print heads.

BACKGROUND OF THE INVENTION

An ink-jet printer is a type of non-impact printer which forms characters and other images by controllably spraying drops of ink from a print head. The print head ejects liquid ink through multiple nozzles in the form of annular drops which travel across a small air gap and land on a recording media. The drops are very small as ink-jet printers commonly print within a range of 180 to 600 dots per inch (dpi). The ink drops dry shortly thereafter to form in combination the desired printed images.

One problem associated with ink-jet printers concerns the amount of ink deposited from the print head during the formation of each drop. The quantity of deposited ink, commonly referred to as the "drop-volume" of the print head, is dependent on the temperature of the print head. If the print head is cool, it will deposit less ink in each droplet. Low drop-volume results in poor quality images that appear faint or washed out. Conversely, if the print head is too hot, it will eject more ink in each droplet. High drop-volume increases the amount of time necessary for the image to dry and can yield poor quality images that appear too dark or have poor resolution. Accordingly, it would be desirable to have the print head deposit an opt/mum drop-volume while at its preferred operating temperature.

However, another printing dynamic is also involved. As a print head is printing, its temperature will gradually rise from an initial temperature to a steady-state operating temperature. As the print head heats up, the amount of ink that is deposited will likewise gradually rise. Another complicating factor is that the print head temperature can fluctuate during each pass of the print head over a recording media. The print head cools down during the non-printing time between the end of the previous line and the start of the next line. The print head then warms up again while printing the next line.

The changing print head temperature makes it difficult to deposit a uniform and optimum amount of ink. If the nominal drop-volume of the print head is set to yield the desired print quality and dry times when the print head is cool, the print head will deposit too much ink on the recording media when it warms up. On the other hand, if the nominal drop-volume of the print head is calibrated so that the print quality and dry times are good when the print head is warm, the print head will eject too little ink causing faint images at the start of the line when the print head is cool. It is therefore desirable to dynamically control the print head temperature to produce a more uniform drop-volume over the printing cycle.

One approach to controlling the print head temperature is described in U.S. Pat. No. 4,910,528, which is assigned to Hewlett-Packard Company. The control system disclosed in this patent maintains the temperature of the print head within an acceptable operating range by measuring the current temperature, predicting the heat loading on a subsequent pass over the recording media, and then adjusting the temperature of the print head. Temperature adjustment can be made by either heating individual ejectors or modifying operation of the printer to permit cooling of the ejectors. Heating is accomplished by applying a low level current to ejector resistors. Cooling is achieved by slowing the printing rate for one or more passes to cool the print head.

Another thermal control system is described in U.S. Pat. No. 5,107,276. To prevent temperature fluctuations, the nozzles of the print head that are not being used to eject ink droplets are selectively energized with energy pulses having insufficient magnitude to vaporize the ink. In this manner, the low energy pulses simply warm the print head without ejecting ink drops. The number of low energy pulses used to warm up the print head is determined by counting the number of ink drops fired in a given time period. A microprocessor is employed for this task. From this drop count, the number of low energy pulses necessary to maintain the print head temperature at the prescribed level is determined via a look-up table. The low energy pulses are then applied to the print head. The ambient or print head temperature may optionally be measured and used to adjust the number of compensating pulses stored in the look-up table. According to this count/look-up/adjust technique, the print head temperature is controlled without having to measure the temperature directly.

This invention is an improvement over the control systems described in U.S. Pat. Nos. 4,910,528 and 5,107,276. This invention provides an effective print head temperature control circuit which is more simple, and thus less costly to implement, than the comparatively more complex systems in these patents.

DISCLOSURE OF THE INVENTION

According to one aspect of this invention, a temperature control circuit for regulating temperature in an ink-jet print head includes a thermal sensor mounted on the print head to measure a temperature of the print head and a temperature level detector coupled to the thermal sensor to determine whether the measured print head temperature exceeds a threshold temperature. The temperature level detector outputs a first signal when the measured print head temperature exceeds the threshold temperature and a second signal when the measured print head temperature does not exceed the threshold temperature. A warming pulse generator produces a continuous series of warming pulses, wherein individual warming pulses have a pulse width of short duration such that the energy of the individual warming pulses is insufficient to cause a deposition of an ink drop from the print head. A firing pulse generator is employed to selectively produce firing pulses, wherein individual firing pulses have a pulse width of a duration longer than the short duration of the warming pulse so that the energy of the individual firing pulses is effective to cause a deposition of an ink drop from the print head. The control circuit further includes first logic circuitry connected to the temperature level detector and the warming pulse generator to output the warming pulses upon receipt of the second signal from the temperature level detector indicating that the measured print head temperature does not to exceed the threshold temperature. Second logic circuitry is connected to the first logic circuitry and the firing pulse generator. As long as the print head temperature is below the threshold temperature, the second logic circuitry outputs to the print head driver(s) at least one of (1) warming pulses to warm the print head and (2) firing pulses to deposit ink drops from the print head.

According to another aspect of this invention, the thermal sensor generates a voltage indicative of the measured print head temperature. Also, the temperature level detector comprises a comparator to compare the voltage from the thermal sensor with a threshold voltage level representative of the threshold temperature.

According to yet another aspect of this invention, an ink-jet print head is configured to incorporate the temperature control circuit.

BRIEF DESCRIPTION OF THE DRAWINGS

Preferred embodiments of the invention are described below with reference-to the following accompanying drawings depicting examples embodying the best mode for practicing the invention.

DETAILED DESCRIPTION OF THE PREFERRED EMBODIMENTS

This invention is intended for use in an ink-jet printer. A typical ink-jet printer includes a platen, a shuttle assembly, an ink-jet print head, and a control system. The platen is preferably stationary and supports a recording media during printing. A media feed mechanism, such as friction rollers or a tractor feed system, is used to drive the media through the printer. The shuttle assembly includes a carriage slidably mounted on a fixed, elongated rod to move bidirectionally across the platen. The print head is mounted to the carriage to print images on the recording media as the carriage moves. The shuttle assembly also includes a drive subassembly (such as a stepper or DC motor, and a belt and pulley linkage) that mechanically maneuvers the drive carriage back and forth along rod.

Figure 1:
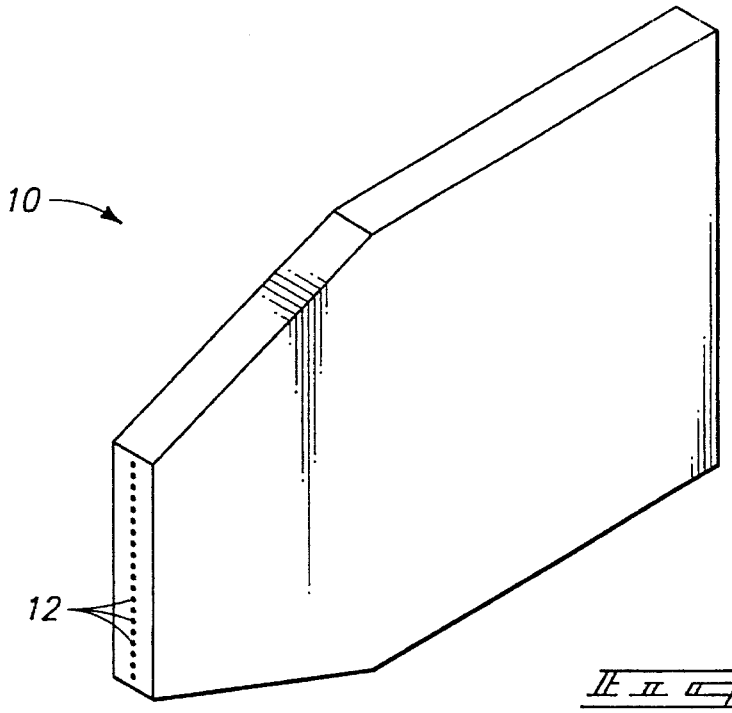
FIG. 1 is an isometric view of a thermal ink-jet print head assembly.

FIG. 1 shows an ink-jet print head 10 in more detail. Print head 10 has multiple nozzles 12. A representative number of nozzles is illustrated, but an example number for one type of commercial print head is 50 nozzles. The nozzles can be arranged in a variety of configurations. Example nozzle arrangements include a single vertical column (i.e., an in-line print head), two side-by-side vertical columns (e.g., parallel or staggered), or a matrix configuration. U.S. Pat. No. 4,910,528 describes one possible print head construction in more detail. This U.S. Pat. No. 4,910,528 is incorporated herein by reference.

Ink droplets are ejected from individual nozzles by localized heating. A small heating element is disposed at individual nozzles. An electrical current is passed through the element to heat it up. This causes a tiny volume of ink to be rapidly heated and vaporized by the heating element and ejected through the nozzle. A driver circuit is coupled to individual heating elements to provide the energy pulses and thereby controllably deposit ink drops from associated individual nozzles. Such drivers are responsive to character generators and other image forming circuitry to energize selected nozzles of the print head and thereby form desired images on the recording media. Energy pulses of effective magnitude to cause deposition of an ink drop from the print head are referred to as "firing pulses".

Figure 2:
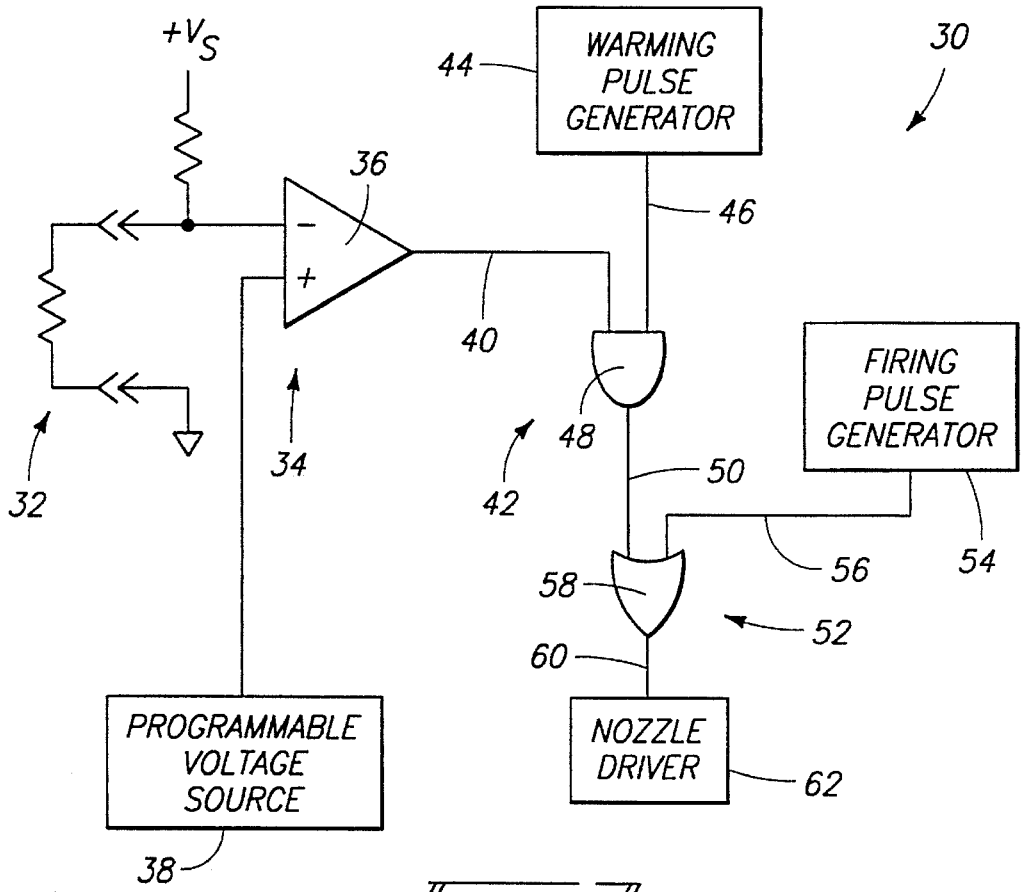
FIG. 2 is a schematic of a control circuit for regulating temperature in the ink-jet print head according to one embodiment of this invention.

FIG. 2 shows a first preferred embodiment of a temperature control circuit 30 for regulating temperature of an ink-jet print head according to this invention. Control circuit 30 is operably connected to print head 10. Control circuit 30 includes a thermal sensor 32 mounted on the print head to measure a temperature of the print head. Thermal sensor 32 monitors the temperature continuously. The thermal sensor 32 is preferably a thermal sensing resistor formed directly on the print head adjacent to the nozzles, but can be implemented in an alternative construction, such as diodes or similar devices. The thermal sensor generates a voltage differential which is a function of the temperature of the resistor, and thus is indicative of the measure print head temperature. A more detailed description of the thermal sensor is provided in the incorporated U.S. Pat. No. 4,910,528, discussed above. In an alternative embodiment, multiple thermal sensors can be employed to measure more localized temperatures of various regions of the print head.

A temperature level detector 34 is coupled to the thermal sensor 32 to determine whether the measured print head temperature exceeds a threshold temperature. In the FIG. 2 embodiment, the temperature level detector 34 comprises a comparator 36 (in the form of a differential amplifier) having its inverting ("minus") input connected to the output of the thermal sensor 32. A programmable voltage source 38 for establishing a threshold voltage level is coupled to the non-inverting ("plus") input of the comparator 36. (Of course, the inputs to the differential amplifier can be reversed with corresponding modifications to the logic circuitry discussed below.) It should be noted that a non-programmable voltage source can be substituted for the programmable voltage source. The non-programmable voltage source could be set during manufacturing to provide the appropriate voltage level, or alternatively, it could be set by a resistor mounted on the print head.

Figure 3:
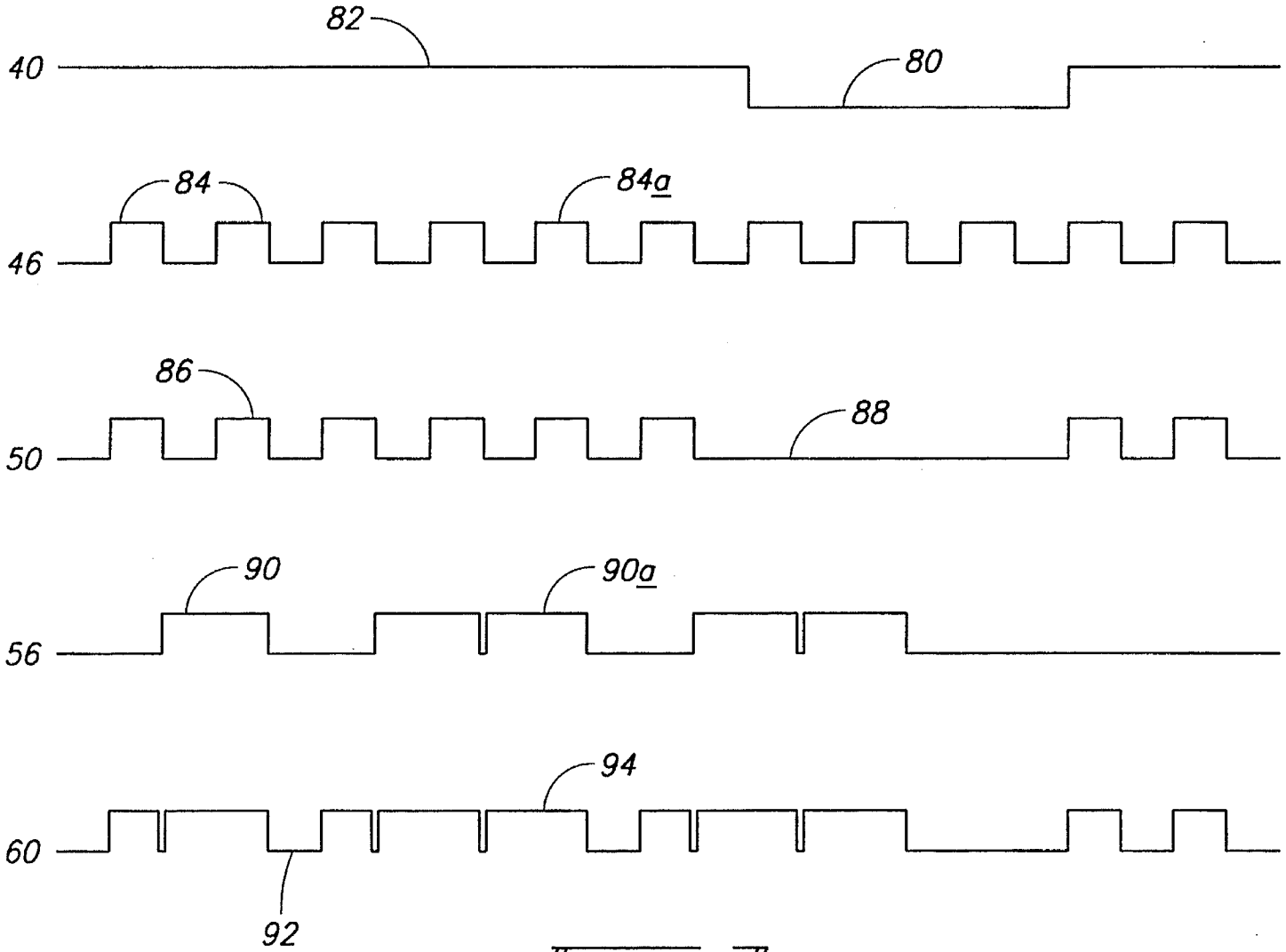
FIG. 3 shows a timing diagram of the signals generated by the FIG. 2 control circuit.

With reference to FIGS. 2 and 3, comparator 36 outputs at terminal 40 a first signal 80 (i.e., an asserted low signal in this configuration) when the voltage from thermal sensor 32 exceeds the threshold voltage level of the programmable voltage source 38. This indicates that the print head temperature is too hot and has exceeded the desired threshold temperature. In this situation, the print head need not be subjected to any warming. On the other hand, comparator 36 outputs at terminal 40 a second signal 82 (i.e., an asserted high signal in this configuration) when the voltage from sensor 32 does not exceed the threshold voltage level. This indicates that the print head temperature is too cool and has not exceeded the threshold temperature. In this case, it is desirable to warm the print head.

Control circuit 30 has first logic circuitry 42 coupled to the temperature level detector 34 and to a warming pulse generator 44. The warming pulse generator 44 produces a continuous series of warming pulses 84 and outputs them on conductor 46. Individual "warming pulses" have a pulse width of short duration so that the energy of the pulse is insufficient to cause a deposition of an ink drop from the print head. The first logic circuitry 42 is preferably in the form of an AND gate 48, although other logic gate(s) can achieve the same logical "AND" function.

First logic circuitry 42 outputs the warming pulses from warming pulse generator 44 upon receipt of the second signal (i.e., the asserted high signal) from the temperature level detector 34. As above, the second signal 82 indicates that the measured print head temperature is cool and has not exceeded the threshold temperature. AND gate 48 therefore outputs on conductor 50 a signal 86 that is essentially identical to the series of warming pulses 84 so long as the asserted high second signal 82 is received. However, during the asserted low first signal 80 from the comparator (indicating that the print head is too warm), AND gate 48 outputs on conductor 50 a low signal 88.

Second logic circuitry 52 is coupled to the first logic circuitry 42, the firing pulse generator 54, and the nozzle driver 62. The firing pulse generator 54 selectively produces firing pulses 90 in response to control information from character generators (or similar components) and outputs them over conductor 56. The selection of which print head nozzles to fire is accomplished by known techniques and is not discussed in detail in this disclosure. Individual "firing pulses" 90 have a pulse width of a duration longer than the shorter duration of the warming pulses so that the energy of the individual firing pulses is effective to cause a deposition of an ink drop from the print head.

The second logic circuitry 52 is preferably in the form of an OR gate 58, although other logic gate(s) can achieve the same logical "OR" function. Second logic circuitry 52 outputs on conductor 60 to the driver 62, a signal 92 containing either warming pulses 84 to warm the print head or firing pulses 90 to deposit ink drops from the print head. The composite waveform output by second logic circuitry 52 is illustrated at the bottom of FIG. 3.

Due to the logical "OR" function, a simultaneous input of a short duration warming pulse 84 and a long duration firing pulse 90 will cause an output essentially identical to the firing pulse. This is shown in FIG. 3 by output signal 94 which is equal in duration to the firing pulse 90*a* and effectively encompasses the warming pulse 84*a*. In this manner, continuous warming pulses are desirably applied to all nozzles when warming the print head, even though some of the nozzles receive firing pulses simultaneously to the warming pulses. If no firing pulse is applied to a particular nozzle, only a warming pulse is output (unless the print head is already adequately warm as indicated by an asserted low output from the comparator).

The temperature control circuit 30 of this invention is advantageous over the complex prior art designs in that circuit 30 is very simple and less costly to implement. Circuit 30 allows application of the firing pulses to the selected nozzles-while automatically applying warming pulses to the non-selected nozzles.

For purposes of clarity, control circuit 30 is illustrated in FIG. 2 as applying a warming or firing pulse to a single nozzle driver 62. As an example implementation, a single nozzle driver 62 and associated second logic circuitry 52 (i.e., "OR" gate 58) is provided for each nozzle (e.g. 50 nozzles) of the print head. In other print heads, however, a single driver 62 and associated second logic circuitry 52 can drive multiple nozzles.

Figure 4:
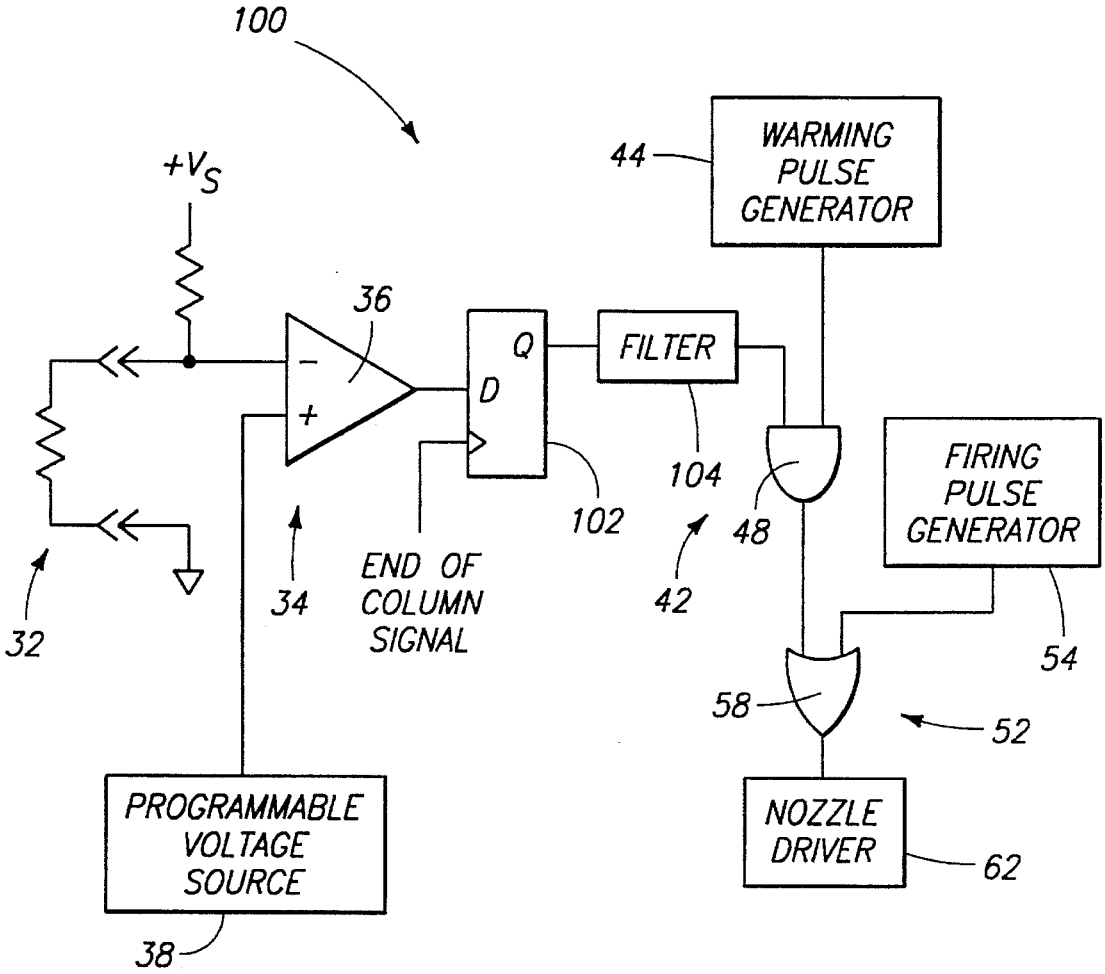
FIG. 4 is a schematic of a control circuit for regulating temperature in the ink-jet print head according to another embodiment of this invention.

FIG. 4 illustrates another preferred embodiment of a temperature control circuit 100 according to this invention. Control circuit 100 is designed to only examine temperature when the print head is not firing, rather than continuously monitoring temperature. Such a configuration prevents any electrical noise caused by the firing pulses from affecting the sensitive temperature measurements. Components that are similar to those employed in circuit 30, discussed above, are labeled with the same numbers.

Control circuit 100 is similar to control circuit 30, but also includes a flip-flop memory 102 and a filter 104 coupled between the temperature level detector 34 and first logic circuitry 42. The filter 104 is a digital filter that reduces electrical noise in the first and second signals output by the comparator 36.

Flip-flop memory 102 samples and stores the first or second signal output from the comparator 36. Preferably, flip-flop memory 102 is a D-type flip-flop which outputs at its Q output the identical signal last received and stored therein. Thus, if the first signal is the last one output by comparator 36, the D flip-flop 102 stores the first signal and places the first signal at the Q output. On the other hand, if the second signal is the last one output by comparator 36, the D flip-flop 102 stores the second signal and places the second signal at the Q output.

Flip-flop memory 102 is responsive to a clock signal which updates the flip-flop memory. The clock signal is preferably the "end of column" signal which is generated after individual columns of drops are printed. In this manner, the print head temperature is measured during the time it takes for the print head to incrementally move from printing one set of dots to the printing the next set of dots. The temperature of the print head is therefore measured many times during each line.

The control circuit 100 has the same advantages of simplicity and low cost. The additional flip-flop memory and filter provide some added benefits without significantly increasing complexity or expense.

In compliance with the statute, the invention has been described in language more or less specific as to structural features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A temperature control circuit for regulating temperature in an ink-jet print head, the temperature control circuit comprising:

a thermal sensor to measure a temperature of the print head and provide a measured print head temperature;

a temperature level detector coupled to the thermal sensor to determine whether the measured print head temperature exceeds a threshold temperature, the temperature level detector outputting a first signal when the measured print head temperature exceeds the threshold temperature and a second signal when the measured print head temperature does not exceed the threshold temperature;

a warming pulse generator for producing a continuous series of warming pulses, individual warming pulses having a pulse width of an effective short duration which is insufficient to cause a deposition of an ink drop when applied to the print head;

a firing pulse generator for selectively producing firing pulses, individual firing pulses having a pulse width of a duration longer than the short duration of one of the warming pulses which is effective to cause a deposition of an ink drop when applied to the print head;

first logic circuitry having one input connected to the temperature level detector, another input connected to the warming pulse generator, and an output, the first logic circuitry providing at the output of the first logic circuitry the warming pulses received from the warming pulse generator upon receipt of the second signal from the temperature level detector which indicates that the measured print head temperature does not exceed the threshold temperature; and second logic circuitry having one input connected to the output of the first logic circuitry, another input connected to the firing pulse generator, and an output, the second logic circuitry providing at the output of the second logic circuitry at least one of (1) the warming pulses to warm the print head and (2) the firing pulses to cause deposition of ink drops from the print head.

2. A temperature control circuit according to claim 1 wherein:

the thermal sensor generates a voltage indicative of the measured print head temperature; and the temperature level detector comprises a comparator to compare the voltage from the thermal sensor with a threshold voltage level representative of the threshold temperature.

3. A temperature control circuit according to claim 1 wherein:

the thermal sensor generates a voltage indicative of the measured print head temperature; and the temperature level detector comprises:

a comparator to compare the voltage from the thermal sensor with a threshold voltage level representative of the threshold temperature, the comparator outputting the first signal when the voltage exceeds the threshold voltage level and the second signal when the voltage does not exceed the threshold voltage level; and a filter operatively coupled to the comparator to reduce electrical noise in the first and second signals.

4. A temperature control circuit according to claim 1 wherein:

the thermal sensor generates a voltage indicative of the measured print head temperature; and the temperature level detector comprises:

a programmable voltage source for establishing a threshold voltage level representative of the threshold temperature; and a comparator to compare the voltage from the thermal sensor with the threshold voltage level established by the programmable voltage source.

5. A temperature control circuit according to claim 1 wherein:

the thermal sensor generates a voltage indicative of the measured print head temperature; and the temperature level detector comprises:

a comparator to compare the voltage from the thermal sensor with a threshold voltage level representative of the threshold temperature, the comparator outputting the first signal when the voltage exceeds the threshold voltage level and the second signal when the voltage does not exceed the threshold voltage level; and a flip-flop memory coupled to the comparator to sample and store the first or second signal output from the comparator, the flip-flop memory sampling the comparator during periods when the print head is not depositing ink drops.

6. A temperature control circuit for regulating temperature in an ink-jet print head, the print head having multiple nozzles and associated drivers, individual drivers providing energy pulses to controllably deposit ink drops from associated individual nozzles to form a desired image, the temperature control circuit comprising:

a thermal sensor mounted on the print head to measure temperature of the print head, the thermal sensor generating a voltage indicative of the temperature of the print head;

a programmable voltage source for establishing a threshold voltage level representative of a threshold temperature;

a comparator to compare the voltage produced by the thermal sensor with the threshold voltage level from the programmable voltage source, the comparator outputting a first signal when the voltage exceeds the threshold voltage level and a second signal when the voltage does not exceed the threshold voltage level;

a flip-flop memory coupled to the comparator to sample and store the first or second signal output from the comparator, the flip-flop memory sampling the comparator during periods when the print head is not depositing ink drops;

a warming pulse generator for producing a continuous series of warming pulses, individual warming pulses having a pulse width of an effective short duration which is insufficient to cause a deposition of an ink drop when applied to the print head;

a firing pulse generator for selectively producing firing pulses, individual firing pulses having a pulse width of a duration longer than the short duration of one of the warming pulses which is effective to cause a deposition of an ink drop when applied to the print head;

first logic circuitry having one input operatively connected to the flip-flop memory, another input connected to the warming pulse generator, and an output, the first logic circuitry providing at the output of the first logic circuitry the warming pulses received from the warming pulse generator when the flip-flop memory stores the second signal from the comparator; and second logic circuitry having one input connected to the output of the first logic circuitry, another input connected to the firing pulse generator, and an output connected to a nozzle driver of the print head, the second logic circuitry providing at the output of the second logic circuitry at least one of (1) the warming pulses to warm the print head and (2) the firing pulses to cause deposition of ink drops from the print head.

7. A temperature control circuit according to claim 6 further comprising a filter operatively coupled between the comparator and the one input of the first logic circuitry to reduce electrical noise in the first and second signals.

8. An ink-jet print head comprising:

multiple nozzles arranged in a predetermined configuration;

a plurality of drivers for corresponding nozzles, individual drivers providing energy pulses to controllably deposit ink drops from the associated individual nozzles;

a thermal sensor mounted to measure temperature of the print head, the thermal sensor generating a voltage indicative of the temperature of the print head;

a programmable voltage source for establishing a threshold voltage level representative of a threshold temperature;

a comparator coupled to compare the voltage from the thermal sensor with the threshold voltage level from the programmable voltage source, the comparator outputting a first signal when the voltage exceeds the threshold voltage level indicating that the print head temperature exceeds the threshold temperature and a second signal when the voltage does not exceed the threshold voltage level indicating that the print head temperature does not exceed the threshold temperature;

a warming pulse generator for producing a continuous series of warming pulses, individual warming pulses having a pulse width of an effective short duration which is insufficient to cause a deposition of an ink drop when applied to one of the drivers;

a firing pulse generator for selectively producing firing pulses, individual firing pulses having a pulse width of a duration longer than the short duration of one of the warming pulses which is effective to cause a deposition of an ink drop when applied to one of the drivers;

first logic circuitry having one input connected to the comparator, another input connected to the warming pulse generator, and an output, the first logic circuitry providing at the output of the first logic circuitry the warming pulses received from the warming pulse generator upon receipt of the second signal from the comparator indicating that the measured print head temperature does not exceed the threshold temperature; and second logic circuitry having one input connected to the output of the first logic circuitry, another input connected to the firing pulse generator, and an output connected to a nozzle driver of the print head, the second logic circuitry providing at the output connected to the nozzle driver (1) the firing pulses for depositing ink drops from selected nozzles of the print head and (2) the warming pulses for warming non-selected nozzles of the print head.

9. An ink-jet print head according to claim 8 further comprising a flip-flop memory coupled to the comparator to sample and store the first or second signal output from the comparator, the flip-flop memory sampling the comparator during periods when the print head is not depositing ink drops.

10. An ink-jet print head according to claim 8 further comprising a filter operatively coupled between the comparator and the one input of the first logic circuitry to reduce electrical noise in the first and second signals.

11. A temperature control circuit for regulating temperature in an ink-jet print head, the temperature control circuit comprising:

a thermal sensor to measure temperature of the print head and thereby provide a measured print head temperature;

a temperature level detector coupled to the thermal sensor to determine whether the measured print head temperature exceeds a threshold temperature;

a warming pulse generator for producing a series of warming pulses, individual warming pulses having a pulse width of an effective short duration which is insufficient to cause a deposition of an ink drop when applied to the print head;

a firing pulse generator for selectively producing firing pulses, individual firing pulses having a pulse width of a duration longer than the short duration of one of the warming pulses which is effective to cause a deposition of an ink drop when applied to the print head; and logic circuitry coupled to the temperature level detector, the warming pulse generator, and the firing pulse generator to (1) simultaneously pass both the warming pulses and the firing pulses to the print head when the temperature level detector determines that the measured print head temperature does not exceed the threshold temperature and (2) pass only the firing pulses to the print head when temperature level detector determines that the measured print head temperature exceeds the threshold temperature.

12. A temperature control circuit according to claim 11 wherein:

the thermal sensor generates a voltage indicative of the measured print head temperature; and the temperature level detector comprises a comparator to compare the voltage from the thermal sensor with a threshold voltage level representative of the threshold temperature.

13. A temperature control circuit according to claim 11 wherein:

the thermal sensor generates a voltage indicative of the measured print head temperature; and the temperature level detector comprises:

a comparator to compare the voltage from the thermal sensor with a threshold voltage level representative of the threshold temperature, the comparator outputting a signal indicative of this comparison; and a filter operatively coupled to the comparator to reduce electrical noise in the signal output by the comparator.

14. A temperature control circuit according to claim 11 wherein:

the thermal sensor generates a voltage indicative of the measured print head temperature; and the temperature level detector comprises:

a programmable voltage source for establishing a threshold voltage level representative of the threshold temperature; and a comparator to compare the voltage from the thermal sensor with the threshold voltage level established by the programmable voltage source.

15. An ink-jet print head which incorporates the temperature control circuit according to claim 11.

* * * * *